United States Patent [19]

Oomen et al.

[11] Patent Number: 4,721,886

[45] Date of Patent: Jan. 26, 1988

[54] HIGH-PRESSURE DISCHARGE LAMP WITH PRECISION END SEAL STRUCTURE

[75] Inventors: Joris J. C. Oomen; Jacobus M. M. Claassens; Jan W. Rouwendal, all of Eindhoven, Netherlands

[73] Assignee: U.S. Philips Corporation, New York, N.Y.

[21] Appl. No.: 804,703

[22] Filed: Dec. 4, 1985

[30] Foreign Application Priority Data

Dec. 18, 1984 [NL] Netherlands ..... 8403830

[51] Int. Cl.[4] ..... H01J 61/36; H01J 9/40

[52] U.S. Cl. ..... 313/623; 313/625; 445/43

[58] Field of Search ..... 313/623, 624, 625, 634; 445/26, 43, 70, 73

[56] References Cited

U.S. PATENT DOCUMENTS

| | | | |
|---|---|---|---|
| 3,726,582 | 4/1973 | Tol et al. | 313/623 X |
| 3,892,993 | 7/1975 | Timmermans | 313/623 X |
| 4,283,652 | 8/1971 | Van Herck et al. | 313/625 |

*Primary Examiner*—Leo H. Boudreau
*Assistant Examiner*—K. Wilder
*Attorney, Agent, or Firm*—Emmanuel J. Lobato

[57] ABSTRACT

The invention relates to a high-pressure discharge lamp provided with a discharge vessel having a ceramic wall and a ceramic end plug which is arranged therein by means of sintering in a sunken position and in which a current-supply member of a main electrode is arranged in a gas-tight manner by means of a sealing ceramic connection. Outside the discharge space enclosed by the discharge vessel, a ceramic filling piece is arranged, which adjoins with a capillary intermediate space the wall of the discharge vessel, the end plug and the current-supply member. The capillary intermediate space is filled substantially entirely with sealing ceramic. With this construction of the vessel end, the sintered joint between the wall of the discharge vessel and the end plug is completely covered by sealing ceramic and the sealing ceramic is prevented from extending into the discharge space.

9 Claims, 3 Drawing Figures

HIGH-PRESSURE DISCHARGE LAMP WITH PRECISION END SEAL STRUCTURE

BACKGROUND OF THE INVENTION

The invention relates to a high-pressure discharge lamp provided with a discharge vessel enclosing a discharge space and having a ceramic wall, which vessel is provided near at least one end with a ceramic end plug in which a current-supply member of a main electrode is arranged in a gas-tight manner by means of a sealing ceramic connection. The end plug is connected by means of a sintered joint to the wall of the discharge vessel in a sunken position with respect to the end of the vessel, which sintered joint between the end plug and the wall of the vessel is covered by sealing ceramic on the side facing the end of the vessel. The invention further relates to a method of obtaining such a lamp.

The term ceramic wall, ceramic end plug or ceramic filling piece as used hereinafter is to be understood to mean herein both a material consisting of polycrystalline metal oxide, such as, for example, densely sintered aluminium oxide, and monocrystalline metal oxide, such as, for example, sapphire. When used as the wall of the discharge vessel, the ceramic material is translucent. The term sealing ceramic used in this description and these claims is intended to mean a connection material having a lower softening temperature than the material of the wall of the discharge vessel, which may be present in the glass phase, or in the cyrstalline phase, or in a combination of these two phases. The discharge vessel contains an ionizable filling, which in general comprises sodium, mercury and a rare gas or a metal halide, mercury and a rare gas.

A lamp of the kind mentioned in the opening paragraph is known from Netherlands Patent Application No. 7704135 and corresponding U.S. Pat. No. 4,198,586. The known lamp is widely used and its discharge vessel has a satisfactory reproducible gas-tight construction. However, in order to obtain such a gas-tight seal, the space outside the discharge space defined by the end of the vessel, the end plug and the current-supply member is partly filled in such a manner that the sintered joint between the wall of the discharge vessel and the end plug is covered by sealing ceramic. In practice, the use of a comparatively large quantity of sealing ceramic leads to the sealing ceramic in the space between the end plug and the current-supply member extending also into the discharge space enclosed by the discharge vessel. Sealing ceramic in the discharge space has proved to be disadvantageous because under the influence of the temperature prevailing in the operating conditions of the lamp it reacts with filling constituents of the discharge vessel. The occurrence of such reactions generally leads to shortening of the life of the lamp.

SUMMARY OF THE INVENTION

The invention has for its object to provide a measure by which sealing ceramic is prevented from extending into the discharge space. For this purpose, a lamp of the kind mentioned in the opening paragraph is characterized in that the discharge vessel is provided outside the discharge space with a ceramic filling piece which adjoins with a capillary intermediate space the wall of the discharge vessel, the end plug as well as the current-supply member, this capillary space being filled substantially entirely with sealing ceramic.

In a construction with a capillary space between the wall of the discharge vessel, the end plug and the current-supply member on the one hand and a ceramic filling piece on the other hand, it has surprisingly proved to be possible both to cover entirely the sintered joint between the wall of the discharge vessel and the end plug by sealing ceramic and to prevent sealing ceramic from extending into the discharge space.

A lamp is known having a non-sunken end plug at the end of the vessel, on which a ceramic part is provided by means of sealing ceramic which extends over the wall of the vessel (cf. Netherlands Patent No. 154.865 and corresponding U.S. Pat. Nos. 3,609,437 and 3,726,582. Although also in this case, the sintered joint between the wall of the discharge vessel and the end plug is covered by sealing ceramic, it proves to be possible only with the use of a comparatively large quantity of sealing ceramic to ensure that the sintered joint is covered by the sealing ceramic in a reproducible manner. However, this positively leads to the situation in which sealing ceramic also extends into the discharge space. The difference in behaviour of sealing ceramic in a construction according to Netherlands Patent No. 154,865 and in a construction according to the invention could not be explained in spite of extensive research.

In an embodiment of a lamp according to the invention, the ceramic filling piece reaches, viewed from the end plug, beyond the end of the discharge vessel. This has the advantage that coverage by sealing ceramic is obtained throughout the length over which the end plug is sunken, as a result of which any leakage path along the wall of the discharge vessel is lengthened to the greatest possible extent.

In a further embodiment of the lamp according to the invention, the capillary space between the wall of the discharge vessel, the end plug and the current-supply member on the one hand and the ceramic filling piece on the other hand has at most a width of 300 $\mu$m. With a width of at most 300 $\mu$m, it has been found that the capillary space is entirely filled with sealing ceramic. In the case in which the capillary space has at least locally a width of more than 300 $\mu$m, it has been found that even with the use of a metered quantity of additional sealing ceramic there is a great possibility that the capillary space is not filled completely. When the quantity of additional sealing ceramic is increased in such a manner that the capillary space in fact is filled completely, this leads to the situation in which the sealing ceramic also extends into the discharge space.

A lamp according to the invention is preferably obtained by a method in which a discharge vessel having a ceramic wall is provided with an end plug in a sunken positions with respect to an end of the vessel and is secured to the wall by means of sintering, this end plug being provided with an aperture through which a current-supply member is passed, which member is to be connected in a gas-tight manner to the end plug by means of sealing ceramic, the discharge vessel further being provided with a ceramic filling piece which adjoins with a capillary intermediate space the wall of the discharge vessel, the end plug and the current-supply member, and is characterized in that sealing ceramic is provided around the current-supply member, whereupon heating takes place, as a result of which the sealing ceramic flows into the capillary intermediate space which is filled substantially entirely with sealing ceramic. The sealing ceramic can then be provided in different forms, for example as a pressed washer, as a powder or as a paste. The sealing ceramic can then be provided entirely around the current-supply member. It is also possible that a part of the sealing ceramic is provided elsewhere, for example near the end of the vessel.

It has been found that flowing sealing ceramic in contact with the metal surface of the current-supply member is transported more rapidly than in a region having only a boundary of ceramic material, as a result of which it is guaranteed more adequately that the capillary intermediate space is completely filled with sealing ceramic if at least a part of the sealing ceramic is provided around the current-supply member.

In an advantageous method, the sealing ceramic is provided on the side of the ceramic filling piece remote from the discharge space in the form of a sealing ceramic washer. An advantage of this method is that the ceramic filling piece is already in the required position and serves to prevent the current-supply member from tilting when the sealing ceramic flows. It has been found that the surface roughness of the end plug and the ceramic filling piece is practice is such that an appropriate capillary space exists between them.

In another advantageous embodiment of the method, the sealing ceramic is provided prior to heating as a paste or as a powder between the end plug and the ceramic filling piece.

The sealing ceramic is provided, before the filling piece is arranged on the end plug, either on the filling piece or on the end plug or on both of them.

An advantage of the method is that even with a low surface roughness of the ceramic filling piece and the end plug, an adequate capillary sealing ceramic layer is formed between them. The method further has the advantage that the sealing ceramic will hardly wet the current-supply member at its surface remote from the filling piece, in comparison with the method that the sealing ceramic is placed on the side of the ceramic filling piece remote from the discharge space. This proves to be favourable to obtain reproducible thermal control behaviour of lamps manufactured by means of the method.

In a further favourable method according to the invention, the provided quantity of sealing ceramic has a volume V which satisfies the relation $0.8\ V_c \leq V \leq V_c$, in which $V_c$ is the volume of the capillary space between the wall of the discharge vessel, the end plug, the ceramic filling piece and the current supply member.

When using the minimum required quantity of sealing ceramic, a satisfactory sealing construction is obtained, in which the capillary space is filled substantially entirely with sealing ceramic, which is efficient and advantageous.

In industrial mass production, it is of major importance that the manufactured products have substantially the same dimensions and properties. Especially in products which have to be mutually exchangeable, this is particularly important. In a high-pressure discharge lamp, the shape of the construction of the end of the discharge vessel is of importance for the thermal control of the discharge vessel. Especially for those lamps of which a part of the filling constituents is present in excess during operation of the lamp, the temperature of the ends of the discharge vessel is of great influence because at the area of these vessel ends the lowest temperature generally prevails within the discharge vessel. The lowest temperature within the discharge vessel determines the pressure of the filling constituents present in excess.

For the thermal control at the area of the ends of the discharge vessel, a difference in the extent of sealing ceramic has proved to exert great influence in comparison with individual lamps from the same production series. By means of the method according to the invention, it has proved to be possible to limit the relative difference in extent of sealing ceramic to dimensions of about 200 μm so that a tolerance of the lowest temperature within the discharge vessel in the same conditions is limited to about 10° C.

As the dimensions of the discharge vessel decrease, the influence on the lamp behaviour of the ends of the discharge vessel will increase and thus the importance of a good controllability of the sealing ceramic extent correspondingly increases. Therefore, the invention is of particular advantage for lamps having a power of less than 100 W.

BRIEF DESCRIPTION OF THE DRAWING

An embodiment of a lamp according to the invention will now be described more fully, by way of example, with reference to a drawing. In the drawing (which is not to scale).

DETAILED DESCRIPTION OF THE DRAWING

Figure 1:
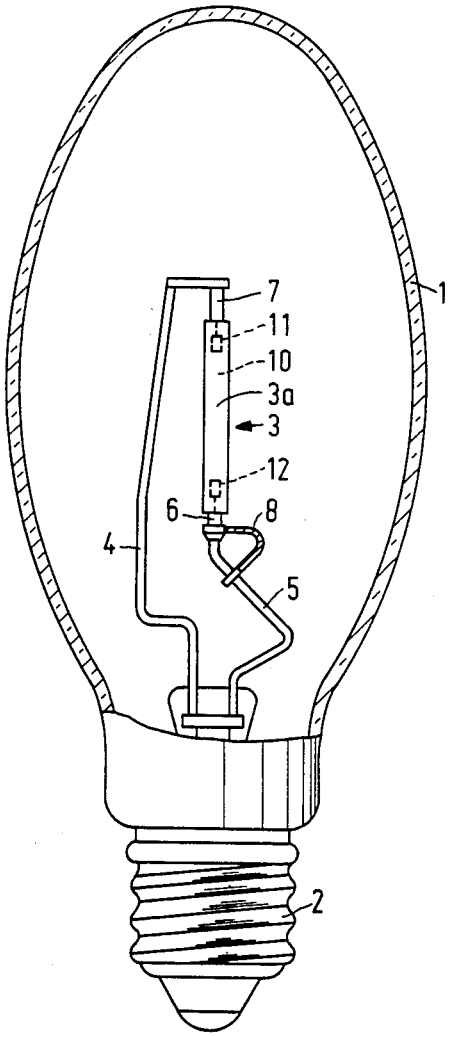
FIG. 1 is a side elevation of a lamp with the outer bulb broken away.

In FIG. 1, a cylindrical discharge vessel 3 enclosing a discharge space 10 is arranged between current conductors 4 and 5 in a glass outer bulb 1 provided with a lamp cap 2. The discharge vessel has a ceramic wall 3a.

Current supply members 6 and 7 in the form of niobium sleeves are arranged in end plugs. Within the discharge vessel 3 the current supply members 6 and 7 are each provided with an electrode 11, 12, between which the discharge extends in the operating condition of the lamp. The current conductor 5 is inserted with clearance into the niobium sleeve 6. A satisfactory electric contact between these two members is guaranteed by Litze wire 8.

Figure 2:
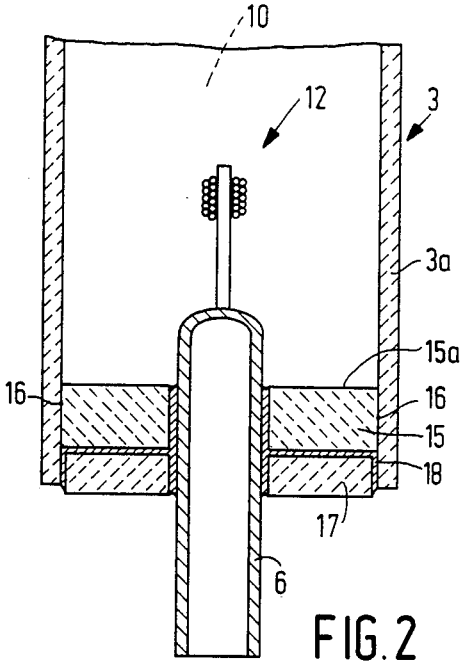
FIG. 2 is a longitudinal sectional view of an end of the discharge vessel of FIG. 1.

In FIG. 2, the discharge vessel 3 is provided at one end with a ceramic end plug 15 which accommodates the current-supply member 6 of the main electrode 12. The end plug 15 is connected by means of a sintered joint 16 to the wall 3a of the discharge vessel 3 in a sunken position with respect to the end of the vessel. The discharge vessel 3 is provided outside the discharge space 10 with a ceramic filling piece 17, which adjoins with a capillary intermediate space the wall 3a of the discharge vessel 3, the end plug 15 and the current-supply member 6. The capillary intermediate space is filled substantially entirely with sealing ceramic 18.

The sealing ceramic 18 then covers completely the sintered joint 16. On the other hand, the sealing ceramic 18 extends in the part of the capillary intermediate space between the current-supply member 6 and the end plug 15 only as far as the surface 15a of the end plug 15 limiting the discharge space 10, and the sealing ceramic 18 is prevented from extending into the discharge space 10.

In the lamp according to the embodiment, the wall of the discharge vessel, like the end plug and the ceramic filling piece, consists of polycrystalline densely sintered aluminium oxide. The filling of the discharge vessel comprises mercury, sodium and a rare gas. The discharge vessel has near the end an inner diameter of 3.4 mm. The end plug is sunken over a length of 0.6 mm with respect to the end of the discharge vessel and has a central aperture having a diameter of 2.06 mm, through which the current-supply member having an outer diameter of 2 mm is passed. The ceramic filling piece has an outer diameter of 3.3 mm, a central aperture having a diameter of 2.06 mm and a height of 0.8 mm, so that, viewed from the end plug, the filling piece extends over 0.2 mm beyond the end of the discharge vessel. The overall volume $V_c$ of the capillary intermediate space between the wall of the discharge vessel, the end plug, the ceramic filling piece and the current-supply member is 5.4 $10^{-9}$ $m^3$. The volume of sealing ceramic provided in the capillary intermediate space is 5.3 $10^{-9}$ $m^3$ so that the capillary intermediate space is filled substantially entirely with sealing ceramic. The sealing ceramic has a composition comprising:

5.6% by weight of MgO
38.6% by weight of CaO
8.7% by weight of BaO
45.4% by weight of $Al_2O_3$
1.7% by weight of $B_2O_3$.

Figure 3:
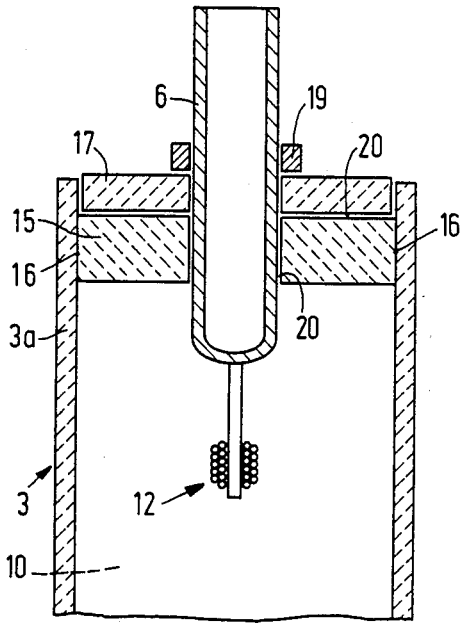
FIG. 3 is a longitudinal sectional view of an end of the discharge vessel during the process of carrying out the method of manufacturing the lamp shown in FIG. 1.

In FIG. 3, the discharge vessel 3 is provided with the end plug 15, which is connected to the wall 3a of the discharge vessel 3 by means of sintering. The sintered joint obtained is denoted by reference numeral 16. The end plug 15 is arranged in a sunken position with respect to the end of the vessel. A ceramic filling piece 17 is arranged on the side of the end plug 15 remote from the discharge space 10. Both the end plug 15 and the ceramic filling piece 17 are provided with an aperture through which the current-supply member 6 is passed. The current-supply member 6 is provided with lugs (not shown) for supporting member 6 on the ceramic filling piece 17. Subsequently, a pressed washer 19 of sealing ceramic is arranged to surround the current-supply member 6 and bears on the side of the ceramic filling piece 17 remote from the discharge space 10.

A capillary intermediate space 20 is formed by the wall 3a of the discharge vessel 3, the end plug 15, the ceramic filling piece 17 and the current-supply member 6. During the further procedure of carrying out the method of manufacturing the lamp shown in FIG. 1, the end of the vessel is heated in a furnace in such a manner that the washer of sealing ceramic flows away into the capillary intermediate space 20 which is filled substantially entirely with sealing ceramic, after which cooling takes place and an end construction as shown in FIG. 2 is obtained.

What is claimed is:

1. A high-pressure discharge lamp provided with a discharge vessel enclosing a discharge space and having a ceramic wall, this vessel being provided at at least one end with a ceramic end plug in which a current-supply member of a main electrode is arranged in a gas-tight manner by means of a sealing ceramic connection, the end plug being connected by means of a sintered joint to the wall of the discharge vessel in a sunken position with respect to the end of the vessel, which sintered joint between the end plug and the wall of the vessel is covered by sealing ceramic on the side facing the end of the vessel, characterized in that the discharge vessel is provided outside the discharge space with a ceramic filling piece for defining a capillary intermediate space between the filling piece and the wall of the discharge vessel, the end plug and the current-supply member, the capillary space being effective for controlling the flow of melted sealing ceramic during lamp manufacture, the capillary space being filled substantially entirely with sealing ceramic and the discharge space within the discharge vessel being substantially free of sealing ceramic.

2. A lamp as claimed in claim 1, characterized in that the ceramic filling piece, viewed from the end plug, extends beyond the end of the discharge vessel.

3. A lamp as claimed in claim 1, characterized in that the capillary space between the wall of the discharge vessel, the end plug and the current-supply member on the one hand and the ceramic filling piece on the other hand has a width of at most 300 $\mu$m.

4. A method of manufacturing a high-pressure discharge lamp as claimed in any one of the preceding claims, in which a discharge vessel having a ceramic wall is provided with an end plug in a sunken position with respect to an end of the vessel and is connected by means of sintering to the wall, this end plug being provided with an aperture through which a current-supply member is passed, which member is to be connected in a gas-tight manner to the end plug by means of sealing ceramic, the discharge vessel further being provided with a ceramic filling piece which adjoins with a capillary intermediate space the wall of the discharge vessel, the end plug and the current-supply member, characterized in that sealing ceramic is provided around the current-supply member, whereupon heating takes place, as a result of which the sealing ceramic flows onto the capillary intermediate space which is filled substantially entirely with sealing ceramic.

5. A method as claimed in claim 4, characterized in that the sealing ceramic is provided as a washer of sealing ceramic on the side of the ceramic filling piece remote from the discharge space.

6. A method as claimed in claim 4, characterized in that the sealing ceramic is provided prior to heating as a paste or as a powder between the end plug and the ceramic filling piece.

7. A method as claimed in claim 5 characterized in that the provided quantity of heating ceramic has a volume V which satisfies the relation $0.8\ V_c \leqq V \leqq V_c$, in which $V_c$ is the volume of the capillary space between the wall of the discharge vessel, the end plug, the ceramic filling piece and the current-supply member.

8. A lamp as claimed in claim 2, characterized in that the capillary space between the wall of the discharge vessel, the end plug and the current-supply member on the one hand and the ceramic filling piece on the other hand has a width of at most 300 $\mu$m.

9. A method as claimed in claim 6, characterized in that the provided quantity of heating ceramic has a volume V which satisfies the relation $0.8\ V_c \leqq V \leqq V_c$, in which $V_c$ is the volume of the capillary space between the wall of the discharge vessel, the end plug, the ceramic filling piece and the current-supply member.

* * * * *